US008576150B2

(12) United States Patent
Iwasa

(10) Patent No.: US 8,576,150 B2
(45) Date of Patent: Nov. 5, 2013

(54) LIQUID CRYSTAL DISPLAY DEVICE HAVING A LINE SYMMETRIC ARRANGEMENT OF CIRCUIT ELEMENTS AND LINES IN POSITIVE-POLARITY SIGNAL PIXEL CIRCUIT PART AND NEGATIVE-POLARITY SIGNAL PIXEL CIRCUIT PART OF EACH PIXEL

(75) Inventor: Takayuki Iwasa, Yokohama (JP)

(73) Assignee: JVC Kenwood Corporation, Yokohama-Shi, Kanagawa (JP)

( * ) Notice: Subject to any disclaimer, the term of this patent is extended or adjusted under 35 U.S.C. 154(b) by 116 days.

(21) Appl. No.: 13/215,558

(22) Filed: Aug. 23, 2011

(65) Prior Publication Data

US 2012/0050147 A1 Mar. 1, 2012

(30) Foreign Application Priority Data

Aug. 24, 2010 (JP) ..... P2010-186864

(51) Int. Cl.
*G09G 3/36* (2006.01)

(52) U.S. Cl.
USPC ..... 345/87

(58) Field of Classification Search
USPC ..... 257/531, 329; 349/110, 139, 48; 29/605; 345/87
See application file for complete search history.

(56) References Cited

U.S. PATENT DOCUMENTS

| | | | | |
|---|---|---|---|---|
| 6,985,201 | B2 * | 1/2006 | Iwasa et al. | 349/137 |
| 7,669,312 | B2 * | 3/2010 | Terrovitis | 29/605 |
| 8,378,415 | B2 * | 2/2013 | Higashino | 257/329 |
| 2009/0032849 | A1 * | 2/2009 | Higashino | 257/262 |
| 2009/0219238 | A1 * | 9/2009 | Furuya et al. | 345/87 |
| 2010/0296015 | A1 * | 11/2010 | Kim et al. | 349/37 |
| 2011/0063535 | A1 * | 3/2011 | Chang et al. | 349/37 |

FOREIGN PATENT DOCUMENTS

| | | | |
|---|---|---|---|
| JP | 4135547 | B2 | 6/2008 |
| JP | 2009-223289 | A | 10/2009 |

* cited by examiner

*Primary Examiner* — Dwayne Bost
*Assistant Examiner* — Sepehr Azari
(74) *Attorney, Agent, or Firm* — Nath, Goldberg & Meyer; Jerald L. Meyer; Stanley N. Protigal

(57) ABSTRACT

Respective lines forming a positive-polarity signal pixel circuit part, such as a Vdd line 102, a Cs1-connecting line 104 and a line 106 for a data line Di+, and respective lines forming a negative-polarity signal pixel circuit part, such as a Vdd line 103, a Cs2-connecting line 105 and a line 107 for a data line Di−, are arranged symmetrically to each other with respect to a pixel center line II-II', respectively. Since the Vdd line 102 and the Vdd line 103 are positioned at right and left ends in one pixel, they serve as guard patterns to restrict crosstalk originating in either a Cs1-connecting line or a Cs2-connecting line of adjacent left and right pixels. The line 106 for the data line Di+ and the line 107 for the data line Di− are arranged in the vicinity of a central portion of the pixel.

3 Claims, 12 Drawing Sheets

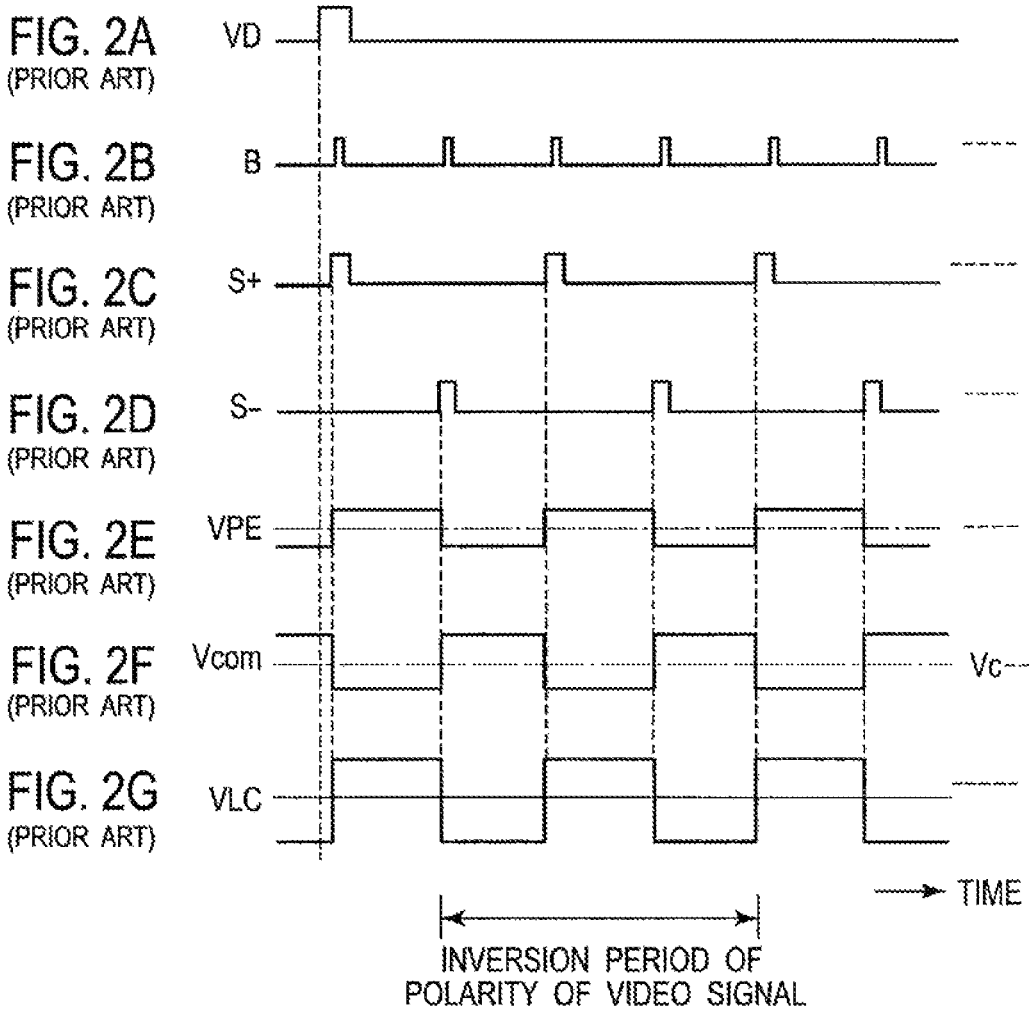
FIG. 3
(PRIOR ART)
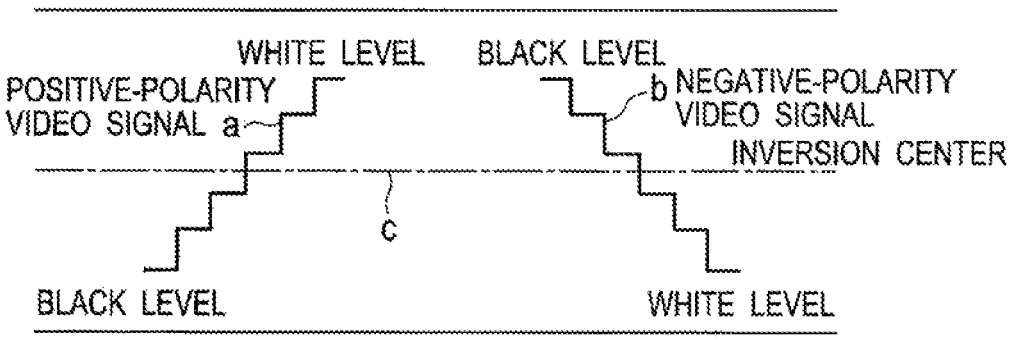

LIQUID CRYSTAL DISPLAY DEVICE HAVING A LINE SYMMETRIC ARRANGEMENT OF CIRCUIT ELEMENTS AND LINES IN POSITIVE-POLARITY SIGNAL PIXEL CIRCUIT PART AND NEGATIVE-POLARITY SIGNAL PIXEL CIRCUIT PART OF EACH PIXEL

BACKGROUND OF THE INVENTION

1. Technical Field

The present invention relates to a liquid crystal display device, more particularly, a liquid crystal display device which samples and retains a positive-polarity video signal and a negative-polarity image signal with respect each pixel individually, retains the signals in two retentive capacities and thereafter applies their hold voltages for the signals to a pixel electrode alternately to drive a liquid crystal element in alternating current.

2. Background Arts

In recent years, there is widely used a LCOS (Liquid Crystal on Silicon) type liquid crystal display device as an essential component to project images on a projector unit or a projection-type television. As this LCOS type liquid crystal display device, Japanese Patent Publication Laid-open No. 2009-223289 discloses a liquid crystal display device which has respective pixels arranged in matrix at intersections between multiple pairs of data lines, each pair consisting of two data lines (column signal lines), and multiple gate lines (row scanning lines) and which allows a positive-polarity video signal and a negative-polarity video signal for each pixel to be independently retained as samples in two retentive capacities and thereafter, applies their hold voltages to pixel electrodes alternately to drive liquid crystal elements in AC (alternating current).

FIG. 1 illustrates an exemplary equivalent circuit diagram of one pixel of this liquid crystal display device. In this figure, one pixel 10 comprises two pixel selecting transistors Q1 and Q2 for writing in positive/negative polarity video signals, two independent retentive capacities Cs1 and Cs2 for retaining voltages for these video signals with both polarities in parallel, respective transistors Q3 to Q7 and one liquid crystal element LC. In the example shown in FIG. 1, all the transistors Q1 to Q7 are formed by N-channel field-effect transistors (FET). However, these transistors do not always have to be formed by N-channel field-effect transistors. The liquid crystal element LC has a well-known structure where a liquid crystal layer (displaying body) LCM is interposed between a pixel electrode PE and a common electrode CE opposed to each other. The transistors Q3 and Q7 and the transistors Q4 and Q7 form so-called "source follower buffers", respectively. The transistors Q3 and Q4 function as signal inputting transistors, while the transistor Q7 functions as a current generator load. The transistor Q7 is arranged on the subsequent stage of the polarity switching transistors Q5 and Q6. Namely, the transistor Q7 is arranged at a node of the pixel electrode PE to serve as a common load for the source follower buffers for two polarities. As the source follower buffers of MOS transistors have almost-infinite input resistances, electrical charges accumulated in the retentive capacities Cs1 and Cs2 are retained without any leakage until signals are newly written after one vertical scanning period.

Further, each pixel includes a positive-polarity data line Di+ and a negative-polarity data line Di− in pairs, which are respectively supplied with video signals of different polarities sampled in a not-shown data-line driving circuit. Respective drain terminals of the pixel selecting transistors Q1 and Q2 are connected to the positive-polarity data line Di+ and the negative-polarity data line Di−, respectively. While, respective gate terminals of the transistors Q1 and Q2 are commonly connected to a row scanning line (gate line) Gj of an identical row.

Next, with reference to the timing charts of FIGS. 2A to 2Q the AC (alternating current) drive control of this pixel 10 will be described in brief. In these figures, FIG. 2A illustrates a vertical synchronizing signal VD, while FIG. 2B illustrates a load-characteristics control signal of the line B, which is applied to a gate of the transistor Q7 in the pixel 10 of FIG. 1. Similarly, FIG. 2C illustrates the waveform of a gate control signal of the line S+, which is applied to a gate of the switching transistor Q5 transferring a positive-polarity drive voltage in the pixel 10, while FIG. 2D illustrates the waveform of a gate control signal of the line S−, which is applied to a gate of the switching transistor Q6 transferring a negative-polarity drive voltage in the pixel 10.

Note that FIG. 3 shows relationships in gray scale between black-level and white-level in positive-polarity and negative-polarity video signals "a", "b" both written in a pixel. As shown in the figure, the positive-polarity video signal "a" designates black level as the minimum gray scale when the signal level is at a minimum and also designates white level as the maximum gray scale when the signal level is at a maximum. In contrast, the negative-polarity video signal "b" designates white level as the maximum gray scale when the signal level is at a minimum and also designates black level as the minimum gray scale when the signal level is at a maximum. The inversion center of the positive-polarity video signal "a" and the negative-polarity video signal "b" is shown with "c".

In FIG. 1, while the gate control signal of the line S+ of FIG. 2C is being at a high level, the positive-polarity switching transistor Q5 is turned on. During this period, if the load characteristics control signal supplied to the line B is at a high level as shown in FIG. 2B, then the source follower buffer is activated so that the node of the pixel driving electrode PE is charged at the level of a positive-polarity video signal. Under condition that the potential of the pixel driving electrode PE is charged completely, if the load characteristics control signal of the line B is switched to a low level and the gate control signal of the line S+ is also switched to a low level as well, the pixel driving electrode PE is brought into its floating condition, so that the liquid crystal capacity is maintained with the positive-polarity drive voltage.

On the other hand, while the gate control signal of the line S− of FIG. 2D is being at a high level, the negative-polarity switching transistor Q6 is turned on. During this period, if the load characteristics control signal supplied to the line B is at a high level as shown in FIG. 2B, then the source follower buffer is activated so that the node of the pixel driving electrode PE is charged at the level of the negative-polarity video signal. Under condition that the potential of the pixel driving electrode PE is charged fully, when the load characteristics control signal of the line B is switched to its low level and the gate control signal of the line S− is also switched to its low level as well, the pixel driving electrode PE is brought into a floating condition, so that the liquid crystal capacity is retained with a driving voltage for negative polarity.

Thereafter, by repeating the operation of intermittently activating the transistor Q7 with use of the load characteristics control signal of the line B in synchronism with the switching operation to turn of the above switching transistors Q5 and Q6 alternately, the pixel electrode PE of the liquid crystal element LC is impressed with a driving voltage VPE alternated in current by respective video signals with positive-polarity and negative-polarity, as shown in FIG. 2E. In this way, as the pixel 10 is adapted so as to not transfer the retained electrical charge to the pixel electrode PE directly but supply the voltages through the source follower buffers, there arises no problem of electrical charges being neutralized in spite of charging and discharging at positive and negative polarities repeatedly, allowing the driving operation to be realized with no attenuation in its voltage level.

In FIG. 2F, Vcom designates a voltage to be applied to the common electrode CE formed on the opposed substrate of the liquid crystal display device. A substantial AC driving voltage of the liquid crystal layer LCM is equal to a differential voltage between the applied voltage Vcom of the common electrode CE and the applied voltage of the pixel electrode PE. As shown in FIG. 2F, the applied voltage Vcom of the common electrode CE is inversed in synchronism with the switching of pixel polarity for a reference level generally equal to the inversion reference level Vc of the potential of the pixel electrode. Consequently, the absolute values of potentials difference between the applied voltage Vcom to the common electrode CE and the applied voltages (of both polarities) to the pixel driving electrode PE always become equal to each other, so that the liquid crystal layer LCM is impressed with alternating-current voltages VLC having no direct-current component, as shown in FIG. 2G In the pixel 10, therefore, by switching the voltage applied to the common electrode CE in reverse phases against the pixel electrode PE, it is possible to reduce the amplitude of voltages supplied to the pixel electrode PE, whereby the withstand voltages of respective transistors on the side of the drive circuit and its power consumption can be saved.

Again, the video signal voltages sampled and retained in the retentive capacities Cs1 and Cs2 are read out by the transistors Q3 and Q4 forming the source follower circuits having high input resistances. Then, the so-readout voltages are alternately selected by the switching transistors Q5 and Q6 that are activated by the gate control signals alternately supplied to the lines S+, S−, as shown in FIGS. 2C and 2D. Successively, the so-selected voltages are applied to the pixel electrode PE, in the form of the drive voltage VPE inverting its polarity (between positive polarity and negative polarity) shown in FIG. 2E. In the pixel 10 of FIG. 1, once respective (positive and negative) video signal voltages are written in the retentive capacities Cs1 and Cs2 during one vertical scanning period (i.e. one frame), the video signal voltages could be selected from the retentive capacities Cs1 and Cs2 to drive the liquid crystal element LC in AC (alternating current) due to alternate switching of the transistors Q5 and Q6, within one frame as many times as one wants until the video signal voltages of the next frame are retained. Thus, the pixel 10 is capable of AC-driving the liquid crystal element LC at a high frequency with no restriction from a vertical scanning frequency, independently of a writing period of video signals.

Irrespective of the vertical scanning frequency, this AC drive frequency can be established by an inversion control period at a pixel circuit freely. Assume that, for instance, the vertical scanning frequency is equal to 60 Hz in general TV video signals, and the liquid display device is constructed by 1125 lines of Full Hi-Vision in the number of vertical-period scanning lines. If the polarity switching of a pixel circuit is performed with a period of about 15 lines, then the AC driving frequency of the liquid crystal element becomes 2.25 kHz (=60 (Hz)×1125/(15×2)), allowing the liquid crystal driving frequency to be enhanced in comparison with the conventional liquid crystal display device dramatically. As a result, it is possible to avoid a phenomenon of burn-in in comparison with a situation where the AC drive frequency of the liquid crystal element is low and also possible to remarkably improve device's reliability/stability while avoiding deterioration (spots etc.) of displaying quality.

SUMMARY OF THE INVENTION

However, as the above-mentioned liquid crystal display device requires seven transistors in one pixel 10, the number of wiring lines for supplying signal to these transistors Q1 to Q7 is relatively large, as shown in FIG. 1. This is because the shown pixel circuit per se has a function of inversing its polarity and consequently, there is realized AC (alternating current) driving at high frequency without no restriction of vertical scanning frequencies by controlling the inversion of polarity at a high speed. That is, this is because the pixel 10 contains wiring lines for writing signals and controlling On/Off of polarity-switching transistors in view of the above-mentioned purpose. Note that the lines for writing the signals and the lines for controlling On/Off of polarity-switching transistors are line that are driven in the logic of GND and a power voltage as amplitude, namely, logic lines.

Meanwhile, the positive-polarity retentive capacity Cs1 and the negative-polarity retentive capacity Cs2 in the pixel 10 of FIG. 1 are required to fix and hold bipolar (positive and negative) analogue voltages for driving the liquid crystal element LC during switching of polarity. The reason is that if the so-held analogue voltage has a potential variance by e.g. several mill volts (mV), the image on display may contain an unfavorable visible pattern exhibiting such a change in potential. From this point of view, the retentive capacities Cs1 and Cs2 have to fix such floating bipolar (positive and negative) hold voltages during a predetermined period (e.g. a period of one frame).

However, each of the retentive capacities Cs1 and Cs2 contains a parasitic capacitance accompanied with the logic lines. Particularly, as the number of wiring lines within one pixel is relatively large in the pixel 10, the values of parasitic capacitances are large. Thus, in the pixel 10, the bipolar (positive and negative) hold voltages could undergo a change of several mill volts (mV) within a predetermined period due to parasitic capacitances between the logic lines and the retentive capacities. It is impossible to remove the parasitic capacitances in principle. In addition, if there exists a relative difference between a first parasitic capacitance between the retentive capacity Cs1 and the logic line and a second parasitic capacitance between the retentive capacity Cs2 and the logic line, then the bipolar (positive and negative) hold voltages respectively vary with changes in signal levels of the logic lines, so that the dynamic range of a driving voltage for liquid crystal is reduced or various problems (e.g. flicker, lower luminance and image burning) arise.

This problem will be described with reference to FIG. 4. FIG. 4 is an equivalent circuit diagram where the above parasitic capacitances are incorporated in the one-pixel circuit of FIG. 1. In FIG. 4, components identical to those of FIG. 1 are indicated with the same reference numerals respectively and their descriptions are eliminated. In FIG. 4, reference numerals C11, C12, C13, C14 designate parasitic capacitances between the positive-polarity retentive capacity Cs1 and respective lines B, Gj, S+, S−, respectively while reference numerals C21, C22, C23, C24 designate parasitic capacitances between the negative-polarity retentive capacity Cs2 and respective lines B, Gj, S+, S−, respectively.

In FIG. 4, the lines B, Gj, S+ and S− are logic lines, respectively. Assume that the signal transmitted through each logic line can take two values: 0V in Off-state and 5V in On-state. At the timing established by the retentive capacities Cs1 and Cs2 under the signal of Off-state, if there is a difference between the parasitic capacitances C11 to C14 accompanied with the retentive capacity Cs1 and the parasitic capacitances C21 to C24 accompanied with the retentive capacity Cs2, the amplitude of a pixel electrode driving voltage VPE, which has been converted in AC (alternating current) by bipolar (positive and negative) video signals applied to the pixel electrode PE, becomes different from a formal amplitude.

Assume that, for instance, the values of the parasitic capacitances C11 to C14 accompanied with the retentive capacity Cs1 are smaller than the values of the parasitic capacitances C21 to C24 accompanied with the retentive capacity Cs2. In the pixel electrode driving voltage VPE, as shown in FIG. 5E, the hold voltage of the negative-polarity video signal read out from the retentive capacity Cs2 greatly changes in the direction VDD due to a crosstalk of the node connected to the gate of the transistor Q4 of the retentive capacity Cs2 with the logic line. On the contrary, the hold voltage of the negative-polarity video signal read out from the retentive capacity Cs2 does not change in potential so much since the node connected to the gate of the transistor Q3 of the retentive capacity Cs1 has a small crosstalk with the logic line. Consequently, the amplitude of the pixel electrode driving voltage VPE becomes smaller than the formal amplitude, causing the dynamic range of a driving voltage to be reduced unfortunately.

For the parasitic capacitance formed between the logic line having a great amplitude and the retentive capacity, if the value of parasitic capacitance on the side of the retentive capacity Cs1 differs from the value of parasitic capacitance on the side of the retentive capacity Cs2, it could be factors of shifting of the voltage Vcom applied to the common electrode, so that the problem of flicker, lower luminance and image burning occurs. Note that the signal waveforms of FIGS. 5A to 5G correspond to the signal waveforms of FIGS. 2A to 2G, respectively.

In order to maintain the dynamic range normally and prevent an occurrence of flicker, lower luminance and image burning, accordingly, there is supposed a measure of reducing the parasitic capacitances accompanied with the retentive capacities Cs1 and Cs2.

Here, if preventing an occurrence of crosstalk between a logic line for transferring a logic signal having a great amplitude and the pixel electrode line transferring video signal voltages as the analogue signals retained in the retentive capacities Cs1 and Cs2, then bipolar hold voltages would be applied to the pixel electrode PE substantially correctly. Such a measure is equivalent to reducing of the parasitic capacitances accompanied with the retentive capacities Cs1 and Cs2. Therefore, based on the similar principle to the technology disclosed in Japanese Patent Publication No. 4135547, it may be expected to prevent an oscillation of voltages in the retentive capacities by disposing, in each pixel, a fixed potential line between the logic line and the pixel electrode line thereby reducing the crosstalk between the logic line and the pixel electrode line. However, to arrangement of such a fixed potential line between the logic line and the pixel electrode line in each pixel causes a pitch of pixels to be increased due to the increased number of lines.

Meanwhile, even if the positive and negative video signal voltages retained in two retentive capacities in each pixel do change due to the parasitic capacitances accompanied with the logic lines, the pixel electrode line and the retentive capacities, an application of a normal drive voltage to the liquid crystal element LC could be realized by adjusting a voltage Vcom to be applied to the common electrode as long as the bipolar hold voltages are shifted by the same voltages (absolute values) respectively.

Under the above-mentioned situation, an object of the present invention is to provide a liquid crystal display device which can apply a normal voltage to a liquid crystal element without increasing a pitch of pixels by adopting an arrangement where paired circuit components and paired lines in both a positive-polarity signal pixel circuit part and a negative-polarity signal pixel circuit part in each pixel are arranged symmetrically to each other with respect to an imaginary pixel center line.

In order to achieve the above object, according to the present invention, there is provided a liquid crystal display device comprising: a plurality of pixels arranged at intersections where multiple pairs of data lines, each pair consisting of two data lines, intersect with a plurality of row scanning lines, each of the pixels including: a liquid crystal element having a liquid crystal layer interposed between a pixel electrode and a common electrode opposed to the pixel electrode; a positive-polarity signal pixel circuit part which allows a positive-polarity video signal to be sampled by a first transistor and successively retained in a first retentive capacity for a certain period and which applies a voltage of the positive-polarity video signal retained in the first retentive capacity to the pixel electrode by a second transistor and a first switching transistor both constituting a source follower; and a negative-polarity signal pixel circuit part which allows a negative-polarity video signal to be sampled by a third transistor and successively retained in a second retentive capacity for the certain period and which applies a voltage of the negative-polarity video signal retained in the second retentive capacity to the pixel electrode by a fourth transistor and a second switching transistor both constituting a source follower, wherein each of the positive-polarity signal pixel circuit part and the negative-polarity signal pixel circuit part is formed by a plurality of metal layers laminated on a semiconductor substrate while interposing interlayer films therebetween, the positive-polarity signal pixel circuit part and the negative-polarity signal pixel circuit part include their mutually-paired circuit components and lines arranged line-symmetrically to either or both of a first pixel center line in parallel with a column-wise direction of the pixels on the metal layers and a second pixel center line in parallel with a cross-sectional direction of the metal layers, power lines of the second transistor and power lines of the fourth transistor on predetermined one of the metal layers are formed in parallel with the first pixel center line, in an outer circumferential position of the pixels, and the first and second switching transistors are switched in a predetermined period shorter than a vertical scanning period to apply the voltage of the positive-polarity video signal and the voltage of the negative-polarity video signal retained in the first and second retentive capacities to the pixel electrode alternately, thereby driving the liquid crystal element in alternating current. These and other objectives and features of the present invention will become more fully apparent from the following description and appended claims taken in conjunction with the accompanied drawings.

BRIEF DESCRIPTION OF THE DRAWINGS

FIGS. 2A to 2G are timing charts for explaining the operation of the pixel of FIG. 1;

FIG. 3 is a diagram to explain the level of drive signals and their inversion for the pixel of FIG. 1;

DETAILED DESCRIPTION OF EMBODIMENTS

Several embodiments of the present invention will be described with reference to the drawings in detail, below.

First, the whole structure of a liquid crystal display device of an embodiment of the present invention will be described below. In the liquid crystal display device, its whole structure per se may be identical to that of the liquid crystal display device disclosed in the above-mentioned patent document. It will be appreciated that the features of the present invention resides in the structure of pixels forming the liquid crystal display device.

Figure 6:
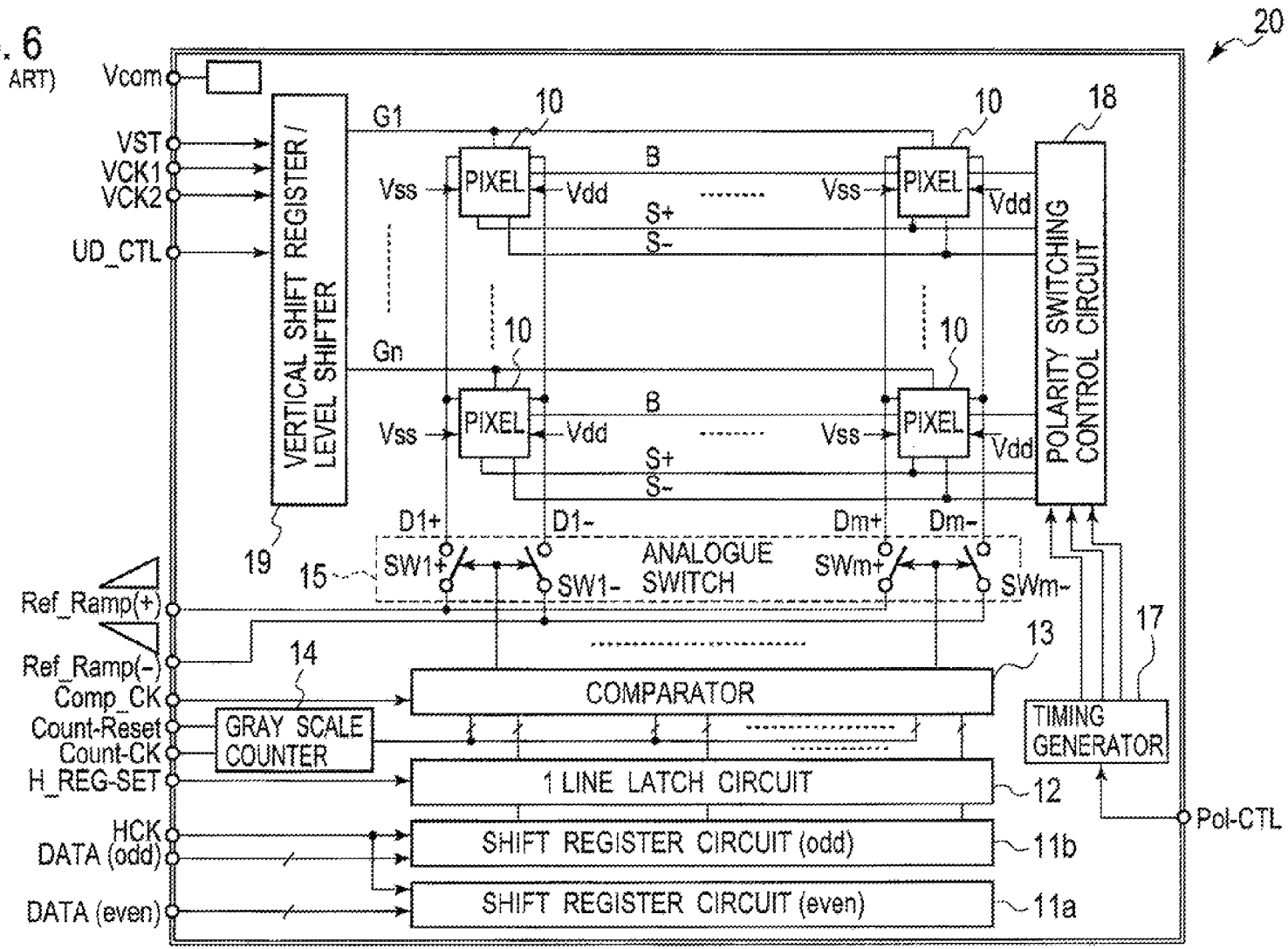
FIG. 6 (PRIOR ART)
FIG. 6 is a whole structural view of the liquid crystal display device in accordance with an embodiment of the present invention.

FIG. 6 illustrates the whole structure of the liquid crystal display device of an embodiment of the present invention. In this figure, the liquid crystal display device 20 comprises shift register circuits 11*a* and 11*b*,an 1-line latch circuit 12, a comparator 13, a gray scale counter 14, an analogue switch 15, pixels 10 arranged in matrix with "m" in the number of pixels in the horizontal direction and "n" in the number of pixels in the vertical direction, each pixel shown with the equivalent circuit of FIG. 1, a timing generator 17, a polarity switching control circuit 18 and a vertical shift register/level shifter 19.

The shift register circuits 11*a* and 11*b*, the 1-line latch circuit 12, the comparator 13 and the gray scale counter 14 constitute a horizontal driver circuit. For convenience of illustration, there is shown the comparator 13 in the form of a single block in FIG. 6. However, it is noted that the comparator 13 is provided with respect to each pixel actually. In the analogue switch 15, there are provided two sampling analogue switches for positive and negative polarities in pairs, with respect to each pixel. Respective pixels 10 are disposed at intersections between diphyletic data lines (D1+ and D1−; . . . ; Dm+ and Dm−) and row scanning lines (G1, . . . Gn).

The polarity switching control circuit 18 outputs positive and negative polarities gate control signals to the above-mentioned lines S+ and lines S−, respectively and further outputs load-characteristics control signals to respective lines B, based on timing signals generated from the timing generator 17. The vertical shift register/level shifter 19 outputs, in turn, a row selecting signal for the row scanning lines G1 to Gn with a period of one horizontal scanning to select any of the row scanning lines G1 to Gn in units of each row scanning line sequentially.

Next, the operation of the device shown in FIG. 6 will be described with reference to the timing charts of FIGS. 7A to 7J. Digital video signals, which are synchronized with horizontal synchronous signals HD of FIG. 7A and also obtained as a result of synthesizing multiple bits of pixel data (DATA) of FIG. 7B in time-series, are sequentially extracted as one line of data by the shift register circuits 11*a* and 11*b*. Then, the so-extracted data is latched by the 1-line latch circuit 12, at the time of completing extraction of data in one line.

Figures 7A, 7B, 7C, 7D, 7E, 7F, 7G, 7H, 7I, 7J:
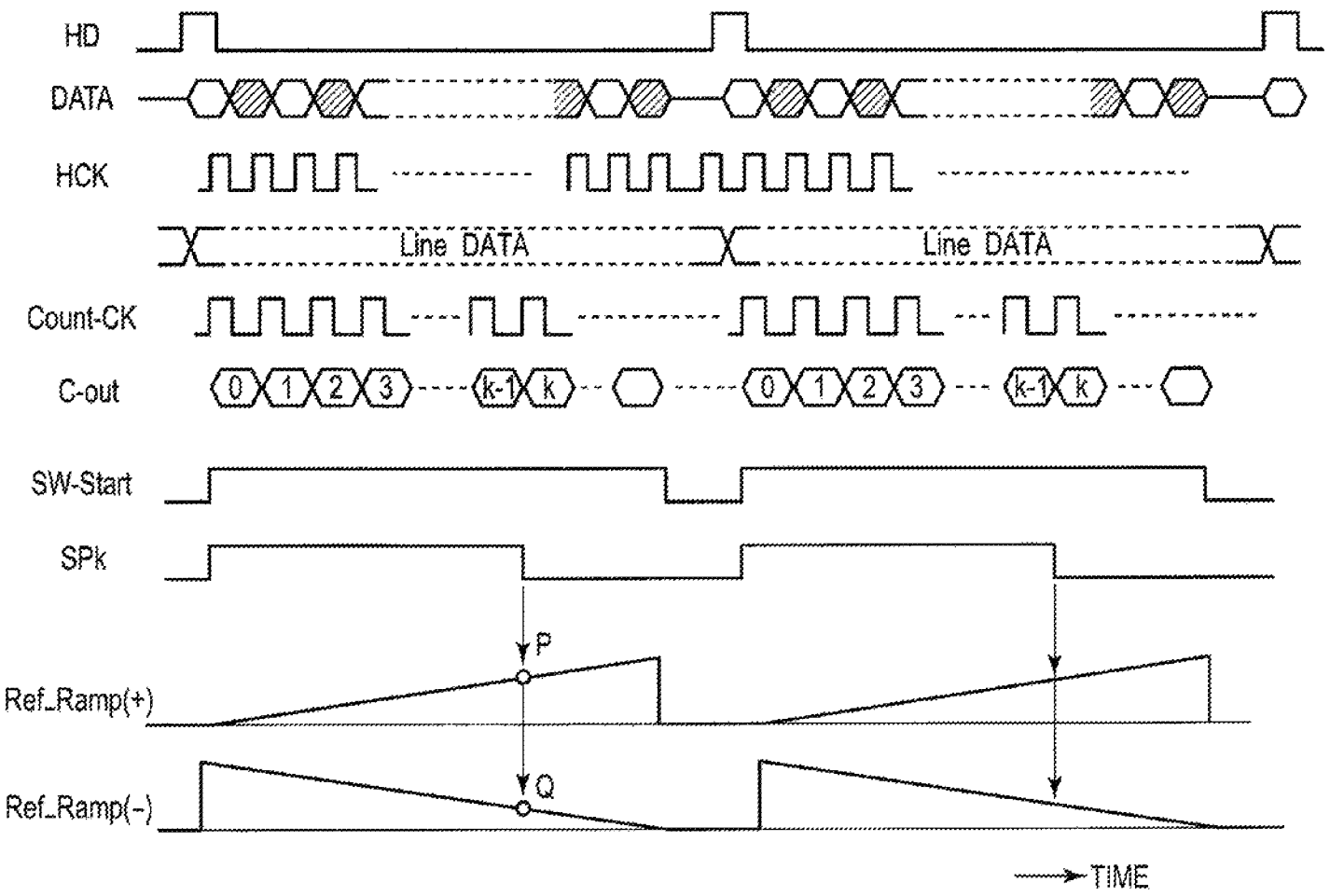
FIG. 7A (PRIOR ART)
FIG. 7B (PRIOR ART)
FIG. 7C (PRIOR ART)
FIG. 7D (PRIOR ART)
FIG. 7E (PRIOR ART)
FIG. 7F (PRIOR ART)
FIG. 7G (PRIOR ART)
FIG. 7H (PRIOR ART)
FIG. 7I (PRIOR ART)
FIG. 7J (PRIOR ART)
FIG. 7 is a timing chart to explain the operation of the liquid crystal display device of FIG. 1.

Note that in the pixel data (DATA) shown in FIG. 7B, even number sequence pixel data DATA (even) illustrated between adjoining white hexagons in the horizontal direction alternately are supplied to the shift register circuit 11*a*, while odd number sequence pixel data DATA (odd) illustrated between adjoining shaded hexagons in the horizontal direction alternately are supplied to the shift register circuit 11*b*. This is intended to facilitate a correspondence of the device to high-speed operation at a high-resolution panel.

The 1-line latch circuit 12 retains the pixel data DATA of the same line within a period of one line, which are composed of the even number sequence pixel data DATA (even) outputted from the shift register circuit 11*a* and the odd number sequence pixel data DATA (odd) outputted from the shift register circuit 11*b*,as typically shown in FIG. 7. Thereafter, the same circuit 12 supplies a first data input part of the comparator 13 in each row of pixels with the pixel data DATA.

The gray scale counter 14 counts up a clock Count-CK shown in FIG. 7E and outputs a count value (reference gray-scale data) C-out where multiple gray values take a round from a minimum value to a maximum value within a period of horizontal scanning as shown in FIG. 7F, with respect to each horizontal scanning to supply a second data input part of the comparator 13 in each row of pixels with the above data. Then, the comparator 13 compares the value of input pixel data DATA at the first data input part with the value of input reference gray data C-out (gray value) at the second data input part and generates a coincident pulse when the former value accords with the latter value.

As for two sampling analogue switches for positive and negative polarities in pairs forming the analogue switch 15, a reference ramp voltage Ref_Ramp(+) as a ramp signal for positive polarity is applied to an input line in common with respective sampling analogue switches for positive polarity by a not-shown ramp signal generator. While, a reference ramp voltage Ref_Ramp(−) as a ramp signal for negative polarity is applied to an input line in common with respective sampling analogue switches for negative polarity by a not-shown ramp signal generator.

As shown in FIG. 7I, the reference ramp voltage Ref_Ramp(+) is represented by cyclic positive scanning signals each having its voltage rising from black level of image to its white level in one horizontal scanning period. On the other hand, as shown in FIG. 7J, the reference ramp voltage Ref_Ramp(−) is represented by cyclic positive scanning signals each having its voltage rising from white level of image to its black level in one horizontal scanning period. Therefore, the reference ramp voltages Ref_Ramp(+) and Ref_Ramp(−) are arranged in the mutually-inversed relation with respect to a predetermined reference potential.

Once the analogue switches 15 are all together turned on at the beginning of respective horizontal scanning periods on receipt of a SW-Start signal of FIG. 7G; their opening/closing operation is controlled in units of pixels so that each analogue switch 15 is turned off at the time of receiving the coincident pulse from the comparator 13 of the corresponding pixel.

In the timing chart of FIGS. 7A to 7J, as an example, the opening/closing timing of the analogue switch 15 for a pixels' row corresponding to the pixel data DATA with gray level "k" is shown by a waveform SPk of FIG. 7H. As a result, there are simultaneously sampled corresponding levels (see points P, Q in FIGS. 7I and 7J) to reference ramp voltages Ref_Ramp(+) and Ref_Ramp(−) when one pair of sampling analogue switches for positive and negative polarities forming the analogue switch 15 for the above pixels' row are simultaneously turned off on receipt of the above coincident pulse and subsequently, the so-sampled corresponding levels are respectively outputted to the pixel data lines Di+, Di− in the pixels' row, as the positive-polarity video signal and the negative-polarity video signal mentioned above. In FIGS. 7I and 7J, the reference ramp voltage levels at points P, Q are analogue voltages obtained by digital-analogue converting the pixel data DATA with gray level "k".

Although all the analogue switches 15 are turned on at the beginning of respective horizontal scanning periods in unison, the timing of turning off these switches, namely, timing of sampling and holding the reference ramp voltage differs from pixel to pixel corresponding to a picture to be displayed at that moment, so that there may be a case of turning of all the switches simultaneously or another case of turning off them at different timings. In addition, it is noted that the order of turning off the switches is not fixed but changed on a case-by-case basis, depending on a picture to be displayed. Such a liquid crystal display device 20 can exhibit advantageous linearity due to its D/A conversion type operation utilizing ramp signals.

Next, the structure of the pixel 10 of the liquid crystal display device 20 as the feature of the present invention will be described.

Figure 1:
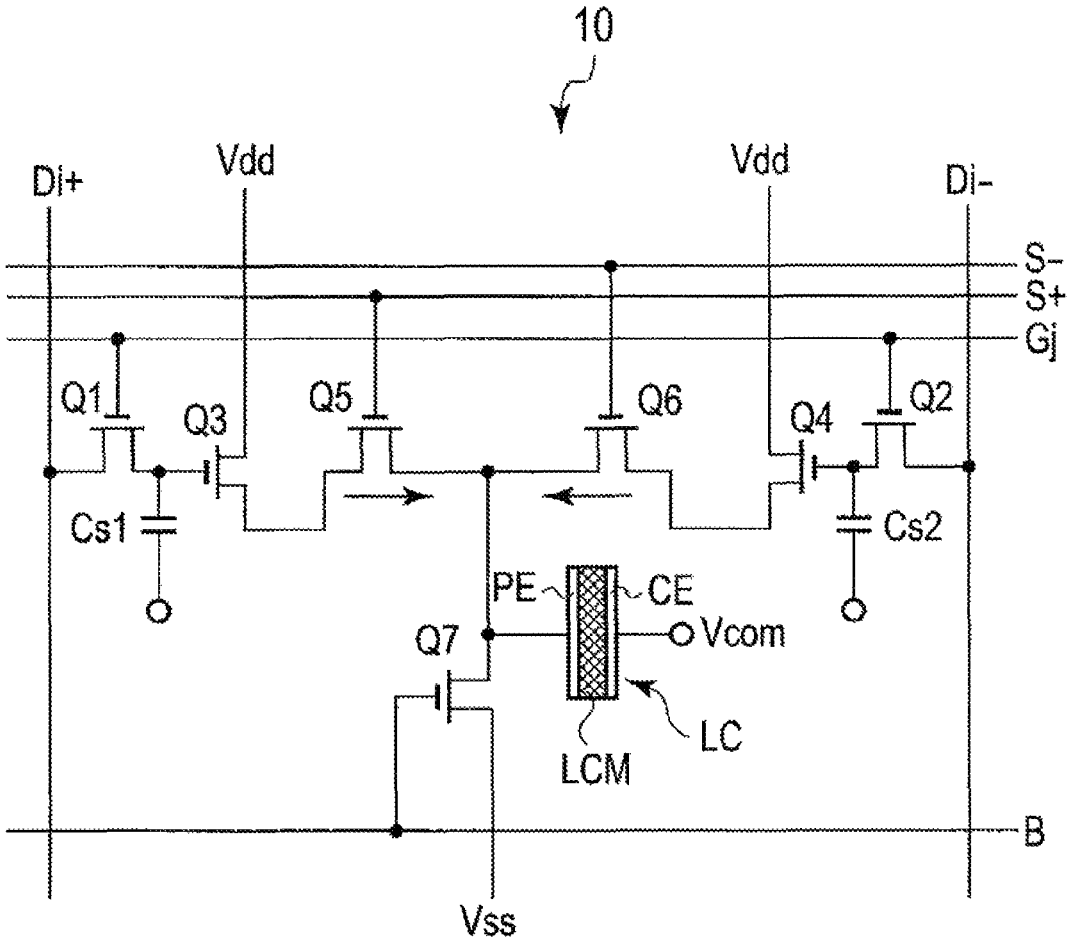
FIG. 1 (PRIOR ART)
FIG. 1 is an exemplary equivalent circuit diagram of one pixel of a liquid crystal display device of the present invention.
Figure 4:
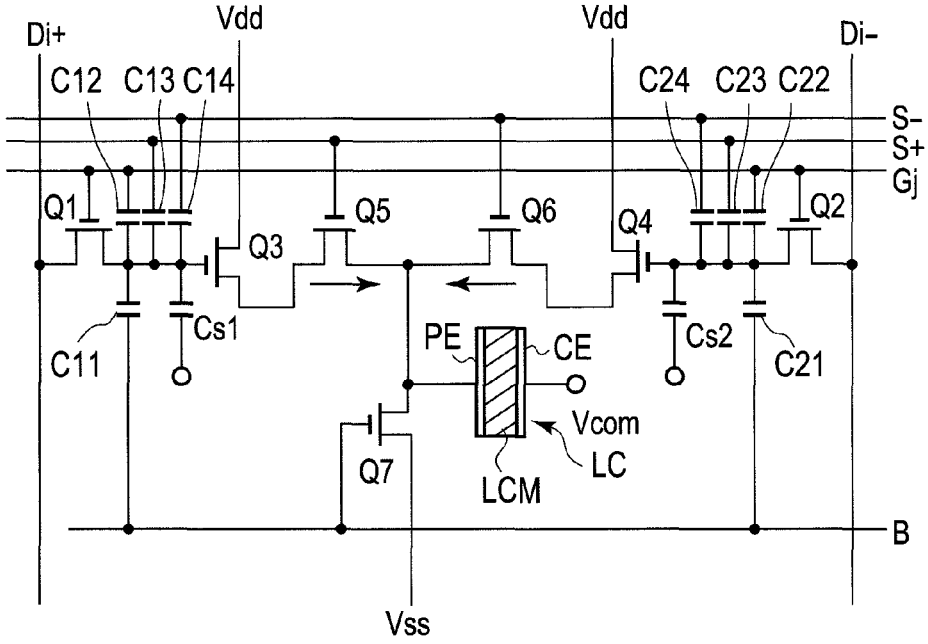
FIG. 4 is an exemplary equivalent circuit diagram to explain parasitic capacity of a pixel of a conventional liquid crystal display device.
Figures 5A, 5B, 5C, 5D, 5E, 5F, 5G:
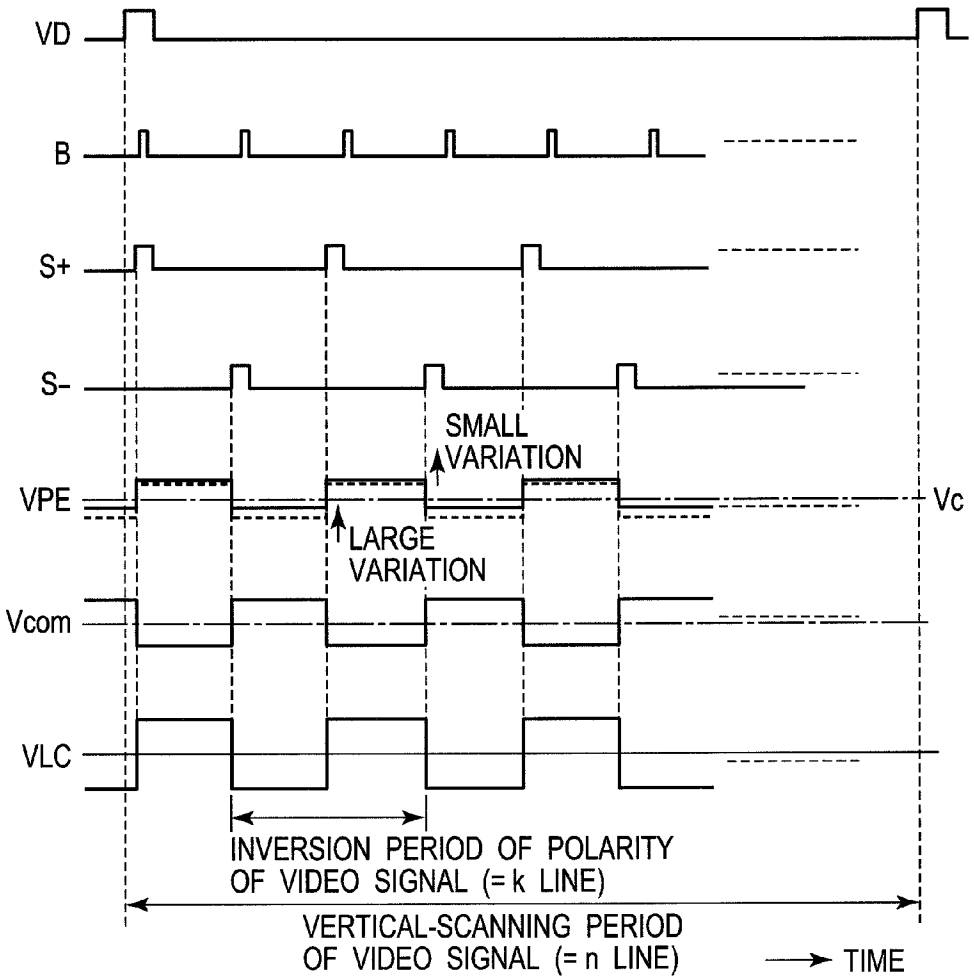
FIGS. 5A to 5G are timing charts for explaining the operation of the pixel of FIG. 4.
Figure 8:
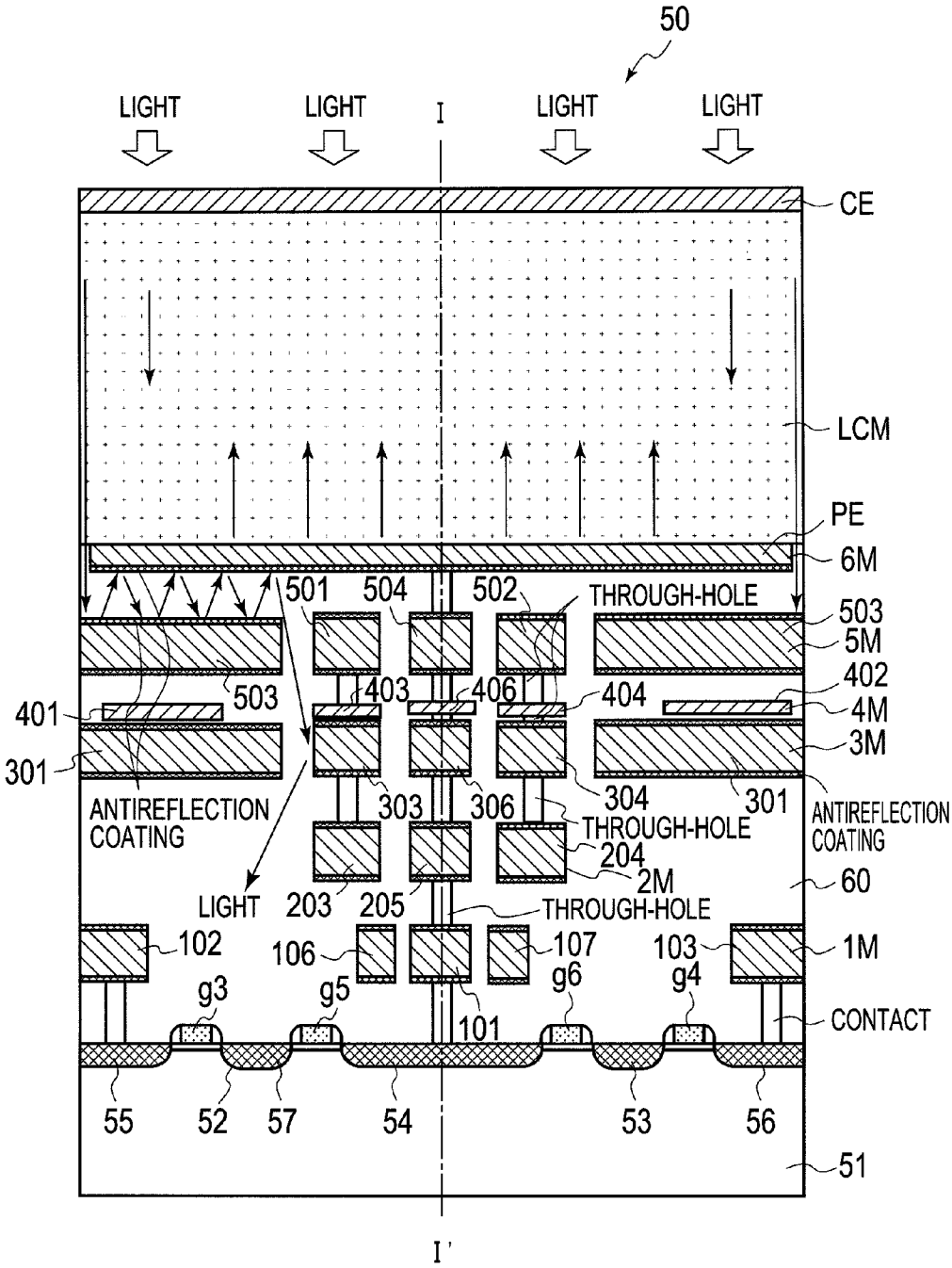
FIG. 8 is a structural sectional view of one pixel of the liquid crystal display device in accordance with an embodiment of the present invention.

FIG. 8 is a structural sectional view of one pixel of the liquid crystal display device in accordance with an embodiment of the present invention. FIGS. 9 to 13 are planer layout views of respective layers of FIG. 8 in accordance with the embodiment of the invention. FIG. 8 is also a sectional view taken along a line A-A' of respective layers of FIGS. 9 to 13. In FIGS. 8 to 13, components identical to those of FIG. 1 are indicated with the same reference numerals respectively and their descriptions are eliminated. Also in FIG. 9, white squares designate through-holes, while black squares designate contact.

In FIG. 8, one pixel 50 corresponding to the pixel 10 of FIG. 6 is represented by an equivalent circuit identical to the pixel 10 of FIG. 1. In the pixel 50, there are laminated a first metal layer 1M, a second metal layer 2M, a third metal layer 3M, a fourth metal layer 4M, a fifth metal layer 5M and a sixth metal layer 6M, which are stacked on a well 51 of the semiconductor substrate in this order while interposing interlayer films 60 between the adjoining metal layers. The sixth metal layer 6M also constitutes a pixel electrode PE; a common electrode CM is formed in the opposite position apart from the pixel electrode PE; and a liquid crystal layer LCM is interposed between the pixel electrode PE and the common electrode CE, thus constituting the liquid crystal element.

In the pixel 50 whose section is shown in FIG. 8, paired circuit components and paired lines in both the positive-polarity signal pixel circuit part and the negative-polarity signal pixel circuit part are arranged symmetrically to each other with respect to an imaginary pixel center line I-I'. In other words, these elements are arranged in a so-called "mirror-inversion" layout pattern. The above positive-polarity signal pixel circuit part comprises the transistors Q1, Q3 and Q5, the retentive capacity Cs1 and the data line Di+ in case of the pixel 10 of FIG. 1. The above negative-polarity signal pixel circuit part comprises the transistors Q2, Q4 and Q6, the retentive capacity Cs2 and the data line Di− in case of the pixel 10 of FIG. 1. Although described in detail later, the transistors Q1 to Q6 are formed on the well 51 as the semiconductor substrate, while the other circuit components and lines are arranged on the metal layers 1M to 6M.

On the well 51, respective gate electrodes g3 and g5 of the transistors Q3 and Q5 are arranged symmetrically with respective gate electrodes g4 and g6 of the transistors Q4 and Q6 with respect to the pixel center line I-I. These gate electrodes g3, g5, g4 and g6 are made from polysilicon. Further, in the well 51, a diffuse layer 52 is formed between the gate electrode g3 and the gate electrode g5, constituting both a source of the transistor Q3 and a drain of the transistor Q5. Also, between the gate electrode g4 and the gate electrode g6, a diffuse layer 53 is formed to constituting both a source of the transistor Q4 and a drain of the transistor Q6. In addition, the well 51 has diffuse layers 55, 56 formed to constitute drains of the transistors Q3 and Q4 and a diffuse layer 54 formed to constitute respective sources of the transistors Q5 and Q6. The above diffuse layer 54 is electrically connected to a pixel electrode line 101 of the first metal layer 1M through a contact/through-hole. The above diffuse layers 55, 56 are connected to Vdd lines 102, 103 of the first metal layer 1M, respectively.

Note that in FIG. 8, respective upper and lower surfaces of the metal layers 1M, 2M, 3M and 5M and the lower surface of the metal layer 6M are coated with antireflection films shown with thick solid lines. Each antireflection film is formed by a metallic membrane, such as Ti or TiN, functioning as a part of the metal layer. While absorbing light irradiated from a gap between the pixel electrodes, the antireflection film also reflects unabsorbed light component. Thus, the longer the optical length of reflected light gets (the more the reflection is repeated), the more the attenuation of reflected light is enhanced.

Figure 9:
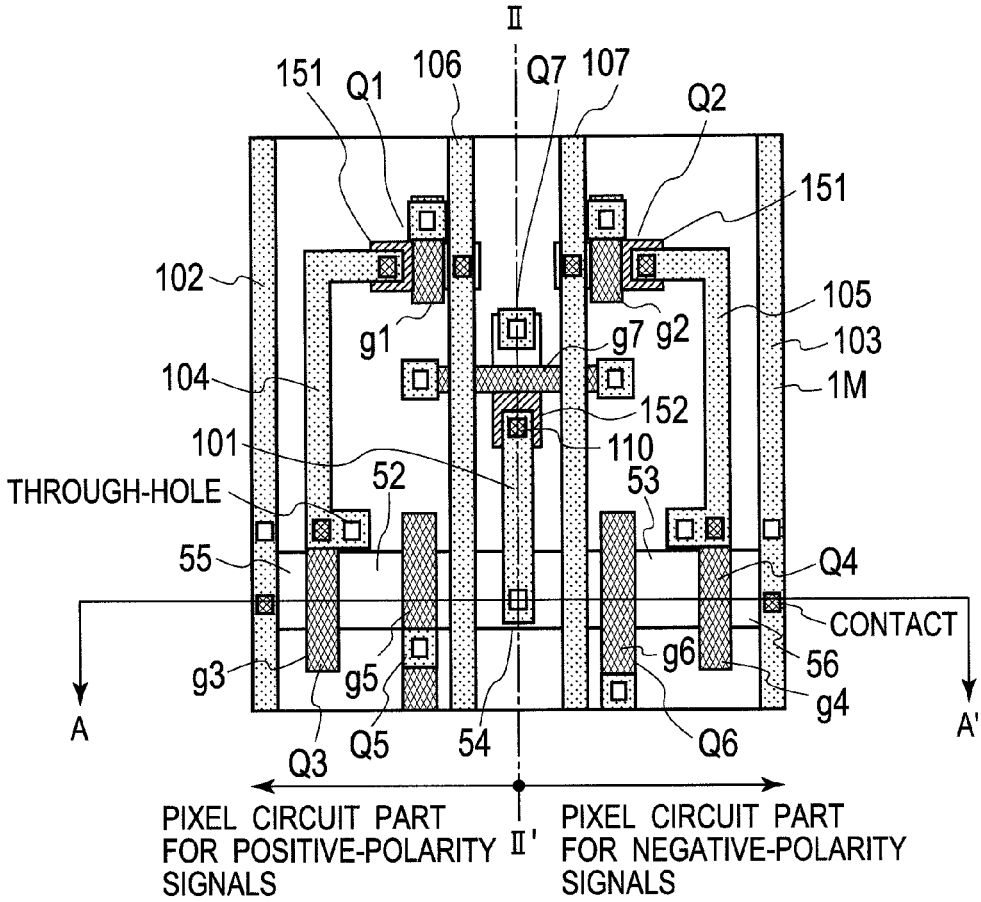
FIG. 9 is a planer layout view of a first metal layer of the pixel of FIG. 8 in accordance with an embodiment of the present invention.

FIG. 9 is a planer layout view of the first metal layer 1M in accordance with the embodiment of the invention. In this figure, elements identical to those of FIG. 8 are indicated with the same reference numerals respectively. In the first metal layer 1M of the pixel 50 shown in FIG. 9, paired circuit components and paired lines in both the positive-polarity signal pixel circuit part and the negative-polarity signal pixel circuit part are arranged symmetrically to each other with respect to an imaginary pixel center line II-II' in parallel with the longitudinal direction of the data lines Di+, Di− in the pixel plane surface (i.e. column-wise direction of a group of pixels arranged in a matrix).

That is, in FIG. 9, respective lines of the positive-polarity signal pixel circuit part, such as the Vdd line 102, a Cs1-connecting line 104 and a line 106 for a data line Di+, and respective lines of the negative-polarity signal pixel circuit part, such as the Vdd line 103, a Cs2-connecting line 105 and a line 107 for a data line Di−, are arranged symmetrically to each other with respect to the pixel center line II-II', respectively. Further, the pixel electrode line 101 and the transistor Q7 in common with the positive-polarity signal pixel circuit part and the negative-polarity signal pixel circuit part are arranged on the pixel center line II-II', respectively.

The line 106 for the data line Di+ is electrically connected to the drain electrode of the transistor Q1 formed on the well 51 of FIG. 8. Similarly, the line 107 for the data line Di− is electrically connected to the drain electrode of the transistor Q2 formed on the well 51 of FIG. 8. Further, the pixel electrode line 101 is electrically connected to respective drain electrodes of the transistors Q5, Q6 and Q7.

As shown in FIG. 9, since the Vdd line 102 and the Vdd line 103 are positioned at right and left ends in one pixel, they serve as guard patterns to restrict crosstalk originating in either a Cs1-connecting line or a Cs2-connecting line in the first metal layer 1M of adjacent left and right pixels. Consequently, the retentive capacities Cs1 and Cs2 can retain stable voltages without being oscillated by unnecessary voltage. The shown Vdd lines 102 and 103 are connected to Vdd lines of the vertically-adjoining pixels for use. On the other hand, as shown in FIG. 9, the line 106 for the data line Di+ and the line 107 for the data line Di− are arranged in the vicinity of the central portion of the pixel to minimize the influence of crosstalk of Vdd lines of external or adjoining pixels on the data lines Di+ and Di−.

Figure 10:
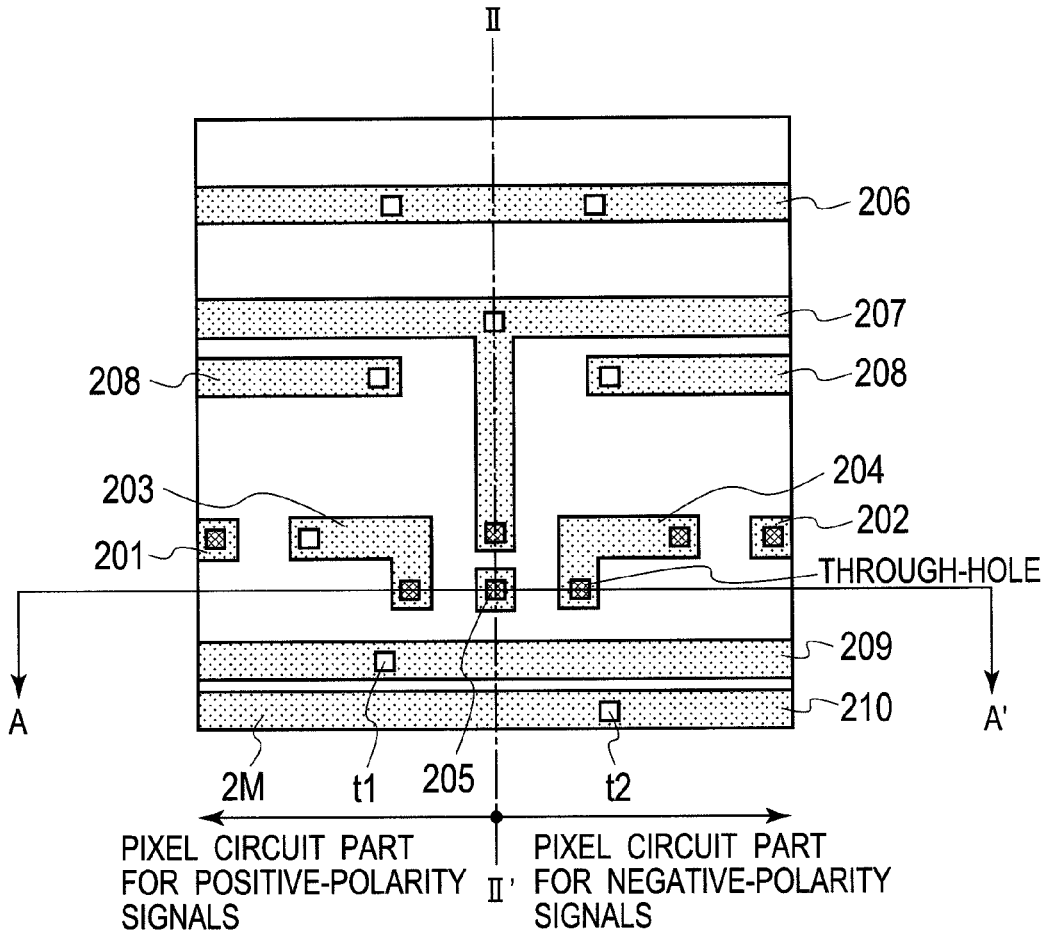
FIG. 10 is a planer layout view of a second metal layer of the pixel of FIG. 8 in accordance with an embodiment of the present invention.

FIG. 10 is a planer layout view of the second metal layer 2M in accordance with the embodiment of the invention. In this figure, elements identical to those of FIGS. 8 and 9 are indicated with the same reference numerals respectively. As shown in FIG. 8, the second metal layer 2M is formed on the first metal layer 1M of FIG. 9 through the interlayer film 60. In the second metal layer 2M of the pixel 50 shown in FIG. 10, paired circuit components and paired lines in both the positive-polarity signal pixel circuit part and the negative-polarity signal pixel circuit part are arranged symmetrically to each other with respect to an imaginary pixel center line II-II' similar to that of FIG. 9.

That is, in FIG. 10, respective lines of the positive-polarity signal pixel circuit part, such as a Vdd line 201 and a Cs1-connecting line 203, and respective lines of the negative-polarity signal pixel circuit part, such as a Vdd line 202 and a Cs2-connecting line 204, are arranged symmetrically to each other with respect to the pixel center line II-II', respectively. Further, a pixel electrode line 205 in common with the positive-polarity signal pixel circuit part and the negative-polarity signal pixel circuit part is arranged on the pixel center line II-II'.

Further, a line 206 for the row scanning line Gj, a line 209 (referred to as "line S+" below) for the line S+for positive-polarity gate control signals and a line 210 (referred to as "line S−" below) for the line S−for negative-polarity gate control signals are arranged so that their longitudinal directions extend in parallel with the row direction of the group of pixels, that is, a direction perpendicular to the pixel center line II-II'. Also, a line (referred to as " line B" below) 208 for the load-characteristics control signal line B is formed so that its longitudinal direction extends in parallel with the row direction of the group of pixels. However, it is noted that the line B is partially interrupted in the vicinity of the center of the second metal layer 2M. A Vss line 207 is T-shaped to have both sides symmetrical to each other with respect to the pixel center line II-II'.

For convenience of wiring, a through-hole t1 of the S+ line 209 and a through-hole t2 of the S− line 210 are arranged asymmetrically to each other with respect to the pixel center line II-II'. These through-holes also contain not-shown contacts. Thus, the S+ line 209 is electrically connected to the gate electrode g5 of the transistor Q5 on the first metal layer M1 through the through-hole t1, while the S− line 210 is electrically connected to the gate electrode g6 of the transistor Q6 on the first metal layer M1 through the through-hole t2.

Through respective through-holes, the Gj line 206 is electrically connected to the gate electrodes g1, g2 of the transistors Q1 and Q2; the Vss line 207 is electrically connected to the drain of the transistor Q7; the B line 208 is electrically connected to the gate electrode g7 of the transistor Q7; the Cs1-connecting line 203 is electrically connected to the gate electrode g3 of the transistor Q3 and the source of the transistor Ql; and the Cs2-connecting line 204 is electrically connected to the gate electrode g4 of the transistor Q4 and the source of the transistor Q2 through a through-hole. Further, the pixel electrode line 205 is electrically connected to the pixel electrode line 101 of the first metal layer M1 through a through-hole, as shown in FIG. 8.

Figure 11:
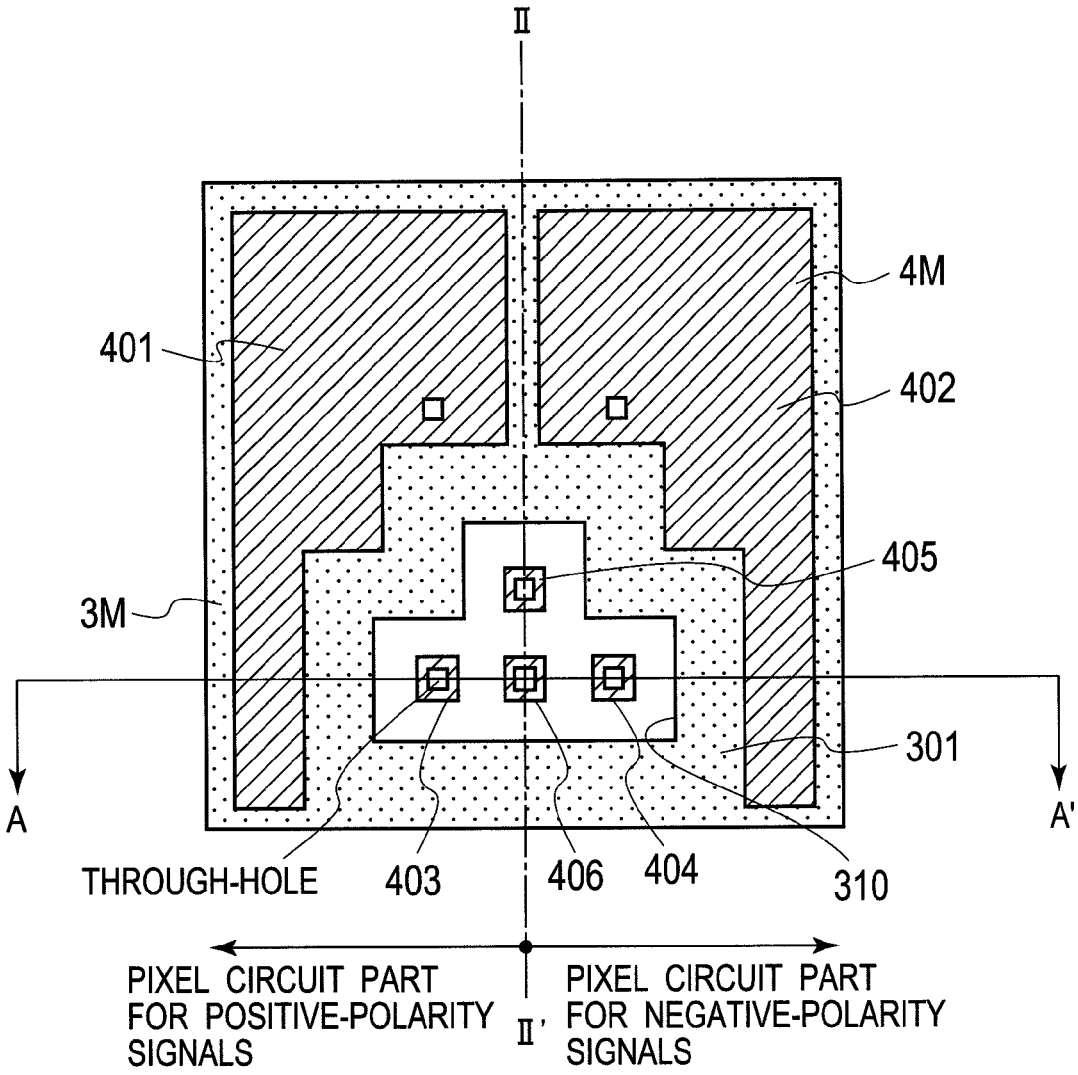
FIG. 11 is a planer layout view of third and fourth metal layers of the pixel of FIG. 8 in accordance with an embodiment of the present invention.

FIG. 11 is a planer layout view of the third metal layer 3M and the fourth metal layer 4M in accordance with the embodiment of the invention. In this figure, elements identical to those of FIGS. 8 and 10 are indicated with the same reference numerals respectively. As shown in FIG. 8, the third metal layer 3M is formed on the second metal layer 2M of FIG. 10 through the interlayer film 60. In addition, the fourth metal layer 4M is formed on the third metal layer 3M through the interlayer film 60, as shown in FIG. 8. Note that FIG. 11 does not illustrate the interlayer film 60 for elimination but shows a plan view viewing the lower third metal layer 3M through the upper fourth metal layer 4M.

In the third and fourth metal layers 3M and 4M shown in FIG. 11, paired circuit components and paired lines in both the positive-polarity signal pixel circuit part and the negative-polarity signal pixel circuit part in the pixel 50 are arranged symmetrically to each other with respect to an imaginary pixel center line II-II' similar to that of FIGS. 9 and 10.

That is, in the fourth metal layer 4M, respective components of the positive-polarity signal pixel circuit part, such as an electrode 401 for the positive-side retentive capacity Cs1 and a Cs1-connecting line 403, and respective components of the negative-polarity signal pixel circuit part, such as an electrode 402 for the negative-side retentive capacity Cs2 and a Cs2-connecting line 404, are arranged symmetrically to each other with respect to the pixel center line II-II', respectively. Further, a Vss line 405 and a pixel electrode line 406 in common with the positive-polarity signal pixel circuit part and the negative-polarity signal pixel circuit part are arranged in respective positions on the he pixel center line II-II' line-symmetrically.

The third metal layer 3M comprises a Vdd line 301 whose surface is formed with a substantial solid pattern. The Vdd line 301 has an opening formed in a central lower position within one pixel. In the third metal layer 3M, its regional part positioned at the lower portion of the electrode 401 for the positive-side retentive capacity Cs1 constitutes a positive-side retentive capacity Cs1 as one circuit component of the positive-polarity signal pixel circuit part by both the non-conductive interlayer film 60 and the electrode 401 for the positive-side retentive capacity Cs1. In the third metal layer 3M, similarly, its regional part positioned at the lower portion of the electrode 402 for the negative-side retentive capacity Cs2 constitutes a negative-side retentive capacity Cs2 as one circuit component of the negative-polarity signal pixel circuit part by both the non-conductive interlayer film 60 and the electrode 402 for the negative-side retentive capacity Cs2. The film thickness of the interlayer film 60 between the third metal layer 3M and the fourth metal layer 4M is set to, for example, about 100 nm in view of increasing respective values of the retentive capacities Cs1, Cs2.

The third metal layer 3M is also formed, in a position beneath the pixel electrode line 406 of the fourth metal layer 4M, with a pixel electrode line 306 (FIG. 8) although it is not shown in FIG. 11 due to the presence of the fourth metal layer 4M. In the third metal layer 3M, additionally, a Cs1-connecting line 303 (FIG. 8) and a Cs2-connecting line 304 (FIG. 8) are formed in respective positions beneath the Cs1-connecting line 403 and the Cs2-connecting line 404 of the fourth metal layer 4M, respectively. The pixel electrode line 406 is electrically connected to the pixel electrode line 306. Similarly, the Cs1-connecting line 403 is electrically connected to the Cs1-connecting line 303, and the Cs2-connecting line 404 is electrically connected to the Cs2-connecting line 304. The third metal layer 3M has a Vss line formed in a position beneath the Vss line 405.

Figure 12:
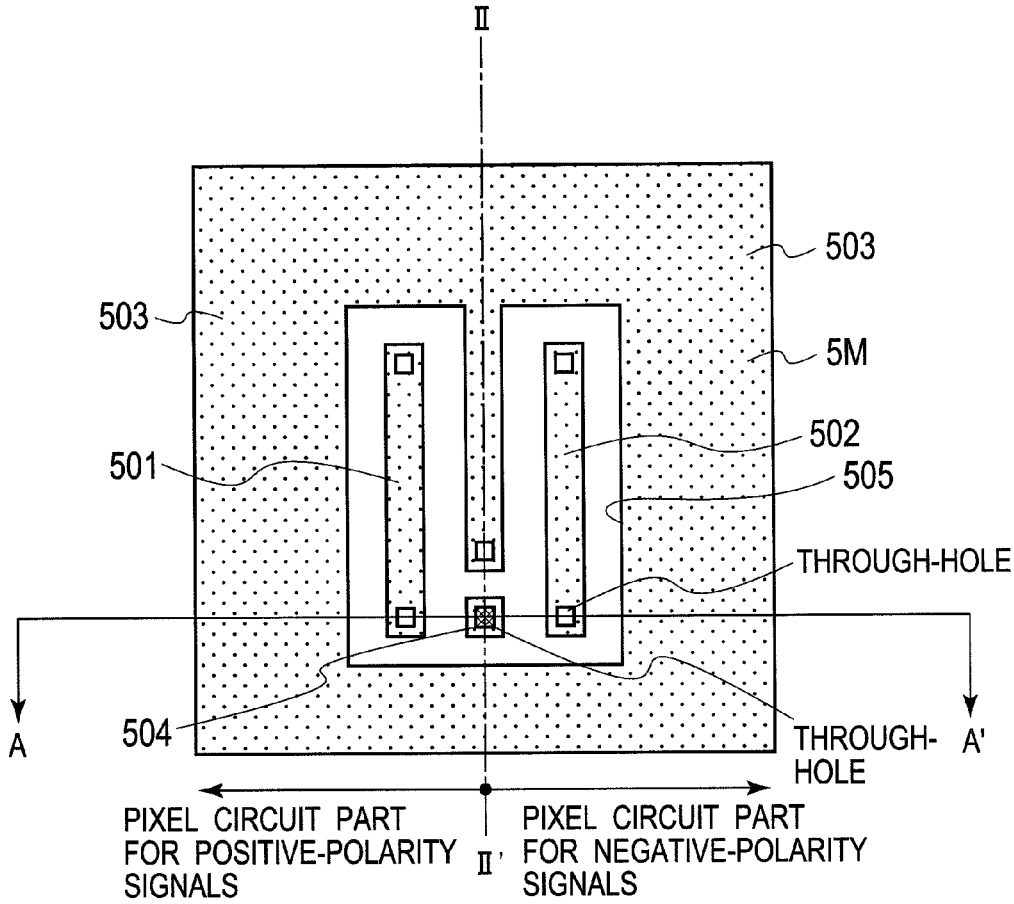
FIG. 12 is a planer layout view of a fifth metal layer of the pixel of FIG. 8 in accordance with an embodiment of the present invention.

FIG. 12 is a planer layout view of the fifth metal layer 5M in accordance with the embodiment of the invention. In this figure, elements identical to those of FIGS. 8 and 11 are indicated with the same reference numerals respectively. As shown in FIG. 8, the fifth metal layer 5M is formed on the fourth metal layer 4M of FIG. 11 through the interlayer film 60. In the fifth metal layer 5M of the pixel 50 shown in FIG. 11, paired circuit components and paired lines in both the positive-polarity signal pixel circuit part and the negative-polarity signal pixel circuit part are arranged symmetrically to each other with respect to an imaginary pixel center line II-II' similar to that of FIGS. 9 to 11.

That is, in FIG. 12, the fifth metal layer 5M comprises an opening 505 formed at a central portion and an outer circumferential line 503 formed around the opening 505. Further, respective lines of the positive-polarity signal pixel circuit part, such as a Cs1-connecting line 501, and respective lines of the negative-polarity signal pixel circuit part, such as a Cs2-connecting line 502, are arranged symmetrically to each other with respect to the pixel center line II-II', respectively. Further, a pixel electrode line 504 in common with the positive-polarity signal pixel circuit part and the negative-polarity signal pixel circuit part is arranged on the pixel center line II-II', line-symmetrically.

Note that the Vss line 503 has its portion arranged on the pixel center line line-symmetrically. As shown in FIG. 8, a pixel electrode line 504 is electrically connected to the pixel electrode line 406. Similarly, the Cs1-connecting line 501 is also electrically connected to the Cs1-connecting line 403 and the electrode 401 for the positive-side retentive capacity Cs1, while the Cs2-connecting line 502 is also electrically connected to the Cs2-connecting line 404 and the electrode 402 for the negative-side retentive capacity Cs2.

Figure 13:
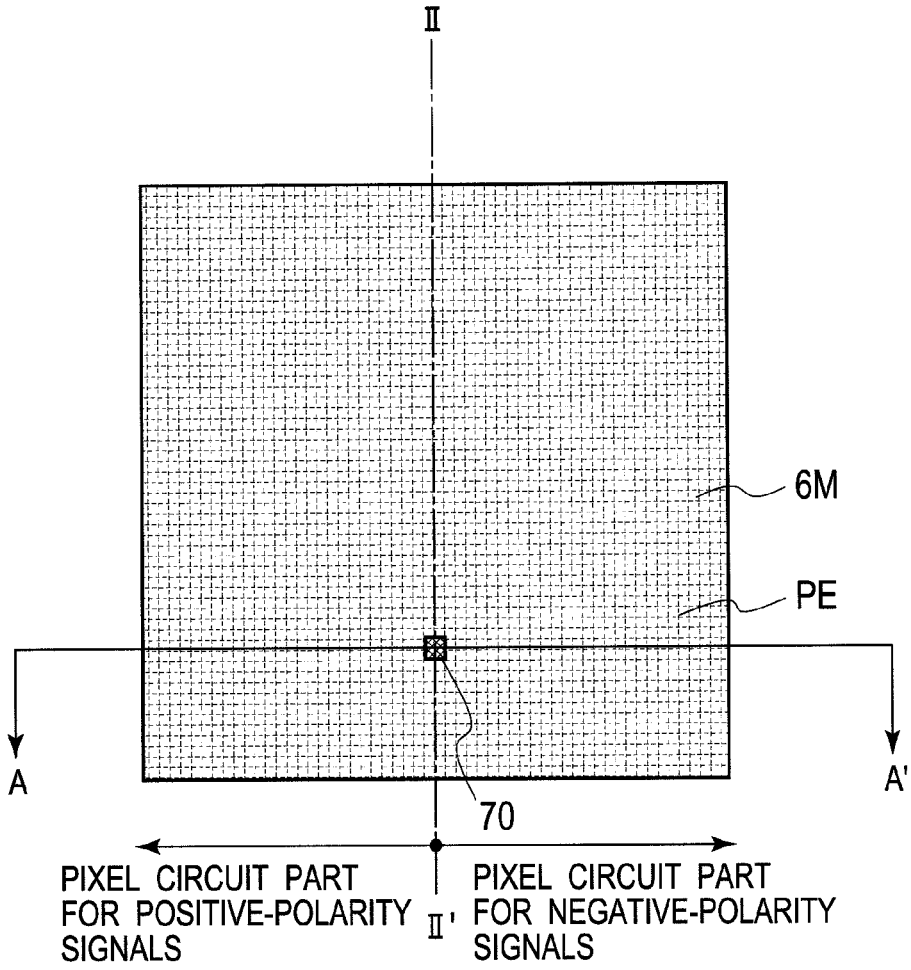
FIG. 13 is a planer layout view of a sixth metal layer of the pixel of FIG. 8 in accordance with an embodiment of the present invention.

FIG. 13 is a planer layout view of the sixth metal layer 6M in accordance with the embodiment of the invention. In this figure, elements identical to those of FIGS. 8 and 1 are indicated with the same reference numerals respectively. As shown in FIG. 8, the sixth metal layer 6M is formed on the fifth metal layer 5M of FIG. 12 through the interlayer film 60.

As shown in FIG. 13, the sixth metal layer 6M is a rectangular-shaped electrode somewhat smaller than one pixel by eliminating its gap portion, constituting the above-mentioned pixel electrode PE of FIG. 1. The sixth metal layer 6M is electrically connected to the pixel electrode line 504 of the fifth metal layer 5M through a through-hole 70. The pixel electrode PE of the sixth metal layer 6M defines respective gap portions against adjoining pixel electrodes.

In this way, according to the embodiment of the invention, since paired circuit components and paired lines in both the positive-polarity signal pixel circuit part and the negative-polarity signal pixel circuit part in each pixel 10 (50) are arranged in line-symmetrical to each other in either cross-sectional or horizontal direction as described together with FIGS. 8 to 13, two pixel circuit parts having positive and negative polarities are provided with the same cross section structures and the same patterns. Thus, the parasitic capacitances of two retentive capacities Cs1 and Cs2 are formed in two pixel circuit parts evenly, and in addition, even interconnection resistance and even transistor characteristics are provided in two pixel circuit parts evenly, allowing unbiased characteristics to be realized in the liquid crystal display device. Concretely, in the manufacturing process, it is possible to realize uniform profiles of etching, photo-lithography, aluminum lines, interlayer films, etc. between two pixel circuit parts having positive and negative polarities, allowing these pixel circuit parts to be formed with uniform interconnection resistances uniform parasitic capacitances therebetween.

In the embodiment of the invention, additionally, the logic lines of respective lines B, S+, S− and Gj is arranged within one pixel horizontally (i.e. row direction) so as to provide bipolar hold voltages with uniform crosstalk, as shown in FIG. 10. Consequently, according to the pixel 50 of this embodiment, as the voltages of bipolar retentive capacities are subjected to the same crosstalk originating in the logic lines, the voltages are equally shifted by the logic signals.

Thus, according to the embodiment of the invention, with the above-mentioned constitution of the pixel 50, even if the bipolar hold voltages vary due to the logic lines and the pixel electrode lines or the parasitic capacitances accompanied with the retentive capacities, it is possible to apply a normal drive voltage to the liquid crystal element without increasing a pixel pitch.

Next, undesired light inside a pixel, problem derived from the light and method of solving the problem by an embodiment of the invention will be described with reference to FIG. 8.

As shown with arrows of FIG. 8, incident light transmitted through the common electrode CE and the liquid crystal layer LCM is almost reflected by the pixel electrode PE and travels in an incident light path in the opposite direction. Nevertheless, as the pixel electrode PE of the sixth metal layer 6M in units of pixel leaves respective gap portions against neighboring pixel electrodes of the adjoining pixels, part of the above incident light enters the fifth metal layer 5M through the gap portions and the interlayer film 60. This light incident on the fifth metal layer 5M gradually attenuates while repeating diffused reflections between an upper antireflection film on the fifth metal layer 5M and a lower antireflection film on the pixel electrode PE (the sixth metal layer 6M). However, part of the reflected light eluding the attenuation is transmitted through spaces among the metal layers 5M, 4M, 3M, 2M and 1M and enters, as the undesired light, the transistors Q1 to Q7 on the well 51.

It is noted here that joints between the diffuse layers 52, 53 forming the drains of the transistors Q3, Q5, Q4 and Q6 and their sources and the wall 51 constitute PN-junction diodes 57, as shown in FIG. 8. Joints between diffuse layer forming the drains of the transistors Q1 and Q2 and their sources and the well 51 also constitute PN-junction diodes although they are not shown in FIG. 8. Therefore, if the above undesired light is irradiated on the diffuse layers forming respective drains and sources of the transistors Q1 and Q2, then the PN junction diodes between the above diffuse layers and the well 51 serve as photodiodes, so that electrical charges stored in the retentive capacities Cs1 and Cs2 may leak out.

In order to realize AC (alternating current) driving of the liquid crystal element at a frequency higher than the vertical scanning frequency, the retentive capacities Cs1 and Cs2 applying a drive voltage to the pixel electrode PE are required to maintain two kinds of hold voltages for the period of one frame. Therefore, it could be said that the retentive capacities Cs1 and Cs2 are sensitive to leakage because even if the leak current is minimal, elongation of retention time would cause the amount of leak current to be increased. The presence of leak current would cause two kinds of hold voltages to be biased in the direction of well voltage as if they were offset in DC (direct current), causing problems, for example, flicker and image burn. Accordingly, it is important to lay out circuit components, lines, etc. such that no undesired light is irradiated on the transistors Q1 and Q2.

Therefore, according to the embodiment of the invention, the opening 310 of the third metal layer 3M is disposed at the pixel's center far from the position of the transistors Q1 and Q2 of FIG. 9, as shown in FIGS. 8 and 11. In addition, according to the embodiment, there are arranged the Cs1-connecting line 303 (FIG. 8), the Cs2-connecting line 304 (FIG. 8), the pixel electrode line 306 (FIG. 8) and the Vss line of the third metal layer 3M in a position corresponding to the Vss line of the fourth metal layer 4M in the opening 310 collectively. As a result, the opening 310 of the third metal layer 3M is formed with a small area.

In addition, as shown in FIGS. 8 and 11, it is contemplated to make an area of the opening 310 of the third metal layer 3M smaller by minimizing respective gaps between the Cs1-connecting line 303 and the pixel electrode line 306, the pixel electrode line 306 and the Cs2-connecting line 304 and also between the pixel electrode line 306 and the Vss line in the position corresponding to the Vss line 405 as possible and by minimizing a gap between the Vdd line 301 and the Vss line (several portions) on the third metal 3M in several positions corresponding to the Cs1-connecting line 303, the pixel electrode line 306, the Cs2-connecting line 304 and the Vss line 405, as possible.

From above, according to the embodiment of the invention, the undesired light is remarkably reduced by the third metal layer 3M with the opening 310 having its minimized area, and the optical path of undesired light is restrained by gathering various through-holes on upper and lower sides of the third metal layer, it is possible to almost eliminate the possibility of undesired light being irradiated on lines under the third metal layer 3M. In addition, according to the embodiment, each gap between adjoining metal lines of the third metal layer 3M is set to a minimum value (e.g. 0.4 μm) realized by a current etching technology to restrict the inversion of light. The third metal layer 3M serves as not only the Vdd line 301 for supplying respective electrodes of the retentive capacities with Vdd potentials but also a light shielding membrane.

It should be noted here that such an invasion of undesired light into the diffuse layers forming respective drains and sources of the transistors Q1 and Q2, which leads to characteristic degradation, arises in connecting points between respective sources 151 (FIG. 9) of the transistors Q1, Q3 and the Cs1-connecting line 104 and between the sources 151 of the transistors Q2, Q4 and the Cs2-connecting line 105. Therefore, according to the embodiment, the characteristic degradation of the transistors Q1 and Q2 due to the above undesired light is avoided by positioning the retentive capacities' diffuse parts (sources) 151, whose characteristics could be degraded by light leakage, far from the opening 310 as shown in FIGS. 9 and 11.

In the above-mentioned embodiment, since the AC driving of a liquid crystal element at a high frequency eluding restrictions of the vertical scanning frequency is realized by allowing the pixel 50 (one pixel 10 of FIGS. 6 and 1) to have a polarity-inverting function and also controlling the inversion of polarities at a high speed, the pixel electrode PE of the liquid crystal element is connected to a diffuse layer forming the drain of the transistor Q7. Therefore, if undesired light enters the diffuse layer as the drain of the transistor Q7, a leak current is produced in the transistor Q7 to make the AC driving of the liquid crystal element asymmetrical in between its positive-polarity side and negative-polarity side, leading to flicker or image burning. This is because if the undesired light is incident on a diffuse layer portion of the transistor Q7, the diffuse layer portion would serve as a photodiode to cause a leakage of electrical charges stored in the liquid crystal layer LCM between the pixel electrode PE and the common electrode CE.

The above undesired light originates in that incident light through a gap portion between the adjoining pixel electrodes PE enters the transistor Q7 through a retentive capacity's diffuse part 152 (FIG. 9) having characteristics deteriorated by light leakage. Therefore, according to the embodiment, such an incidence of undesired light on the transistor Q7 is remarkably prevented by arranging a contact/through hole 110 where the pixel electrode line 101 of the first metal layer 1M is connected to the diffuse layer forming the drain of the transistor Q7, at a pixel center farthest from each gap portion between the pixel 50 and the adjoining pixel.

It is noted that the present invention is not limited to only the above-mentioned embodiment. Although respective patterns of the metal layers 1M to 5M are mirror-inversed within one pixel in the above-mentioned embodiment, the mirror inversion may be directed to a major metal layer only. What is important is to make a layout where the positions of respective transistors, their lines for supplying the transistors with power, retentive capacities, etc. are mirror-inversed within one pixel.

Again, although the above-mentioned embodiment is illustrative of N-channel field-effect transistors (FET), the present invention may be applied to P-channel field-effect transistors in a modification. Then, for example, the Vdd line as a power line would become a GND (ground) line.

As mentioned above, according to the present invention, since paired circuit components and paired lines in both the positive-polarity signal pixel circuit part and the negative-polarity signal pixel circuit part in each pixel are arranged symmetrically to each other with respect to an imaginary pixel center line, the parasitic capacitances of two retentive capacities of the above pixel circuit parts are formed evenly, and in addition, even interconnection resistance and even transistor characteristics are provided in two pixel circuit parts. Consequently, it is possible to realize unbiased characteristics in the liquid crystal display device, allowing a normal drive voltage to be applied to a liquid crystal element without increasing a pitch of pixels. Finally, it will be understood by those skilled in the art that the foregoing descriptions are nothing but one embodiment of the disclosed liquid crystal display device and therefore, various further changes and modifications may be made within the scope of claims.

What is claimed is:

1. A liquid crystal display comprising:

a plurality of pixels arranged at intersections where multiple pairs of data lines, each pair consisting of two data lines, intersect with a plurality of row scanning lines, each of the pixels including:

a liquid crystal element having a liquid crystal layer interposed between a pixel electrode and a common electrode opposed to the pixel electrode;

a positive-polarity signal pixel circuit part which allows a positive-polarity video signal to be sampled by a first transistor and successively retained in a first retentive capacity for a certain period and which applies a voltage of the positive-polarity video signal retained in the first retentive capacity to the pixel electrode by a second transistor and a first switching transistor both constituting a source follower; and a negative-polarity signal pixel circuit part which allows a negative-polarity video signal to be sampled by a third transistor and successively retained in a second retentive capacity for the certain period and which applies a voltage of the negative-polarity video signal retained in the second retentive capacity to the pixel electrode by a fourth transistor and a second switching transistor both constituting a source follower, wherein each of the positive-polarity signal pixel circuit part and the negative-polarity signal pixel circuit part is formed by a plurality of metal layers laminated on a semiconductor substrate while interposing interlayer films therebetween, the positive-polarity signal pixel circuit part and the negative-polarity signal pixel circuit part include their mutually-paired circuit components and lines arranged line-symmetrically to either or both of a first pixel center line in parallel with a column-wise direction of the pixels on the metal lavers and a second pixel center line in parallel with a cross-sectional direction of the metal layers, power lines of the second transistor and power lines of the fourth transistor on predetermined one of the metal layers are formed in parallel with the first pixel center line, in an outer circumferential position of the pixels, and the first and second switching transistors are switched in a predetermined period shorter than a vertical scanning period to apply the voltage of the positive-polarity video signal and the voltage of the negative-polarity video signal retained in the first and second retentive capacities to the pixel electrode alternately, thereby driving the liquid crystal element in alternating current, wherein each of the metal layers includes a first through-hole and contact formed on the first pixel center line and the second pixel center to connect the pixel electrode with respective output terminals of the first and second switching transistors, the first and second retentive capacities are formed by first and second metal layers of the plurality of metal layers, the first metal layer being adjacent to the second metal layer, and one interlayer film between the first metal layer and the second metal layer, the positive-polarity signal pixel circuit part includes a second through-hole and contact formed in predetermined two or more metal layers to connect the first retentive capacity with the first and second transistors on the semiconductor substrate, respectively, the negative-polarity signal pixel circuit part includes a third through-hole and contact formed in the predetermined two or more metal layers to connect the second retentive capacity with the third and fourth transistors on the semiconductor substrate, respectively, the second through-hole and contact and the third through-hole and contact are arranged symmetrically to each other with respect to the first pixel center line and also arranged at the substantial center of the pixel so as to adjoin the first through-hole and contact, and an opening is formed at a central portion of the pixel excepting at least pixel portions forming the first through-hole and contact, the second through-hole and contact and the third through-hole and contact on either the first metal layer or the second metal laver, which is closer to the semiconductor substrate.

2. The liquid crystal display device of claim 1, wherein the first metal layer and the second metal layer are respectively coated with antireflection films.

3. The liquid crystal display device of claim 1, wherein either the first metal layer or the second metal layer, which is closer to the semiconductor substrate, has metal lines positioned in the opening and separated from each other through a gap minimized by a current etching technology, wherein the metal lines include: a pixel electrode line for connecting the pixel electrode with respective output terminals of the first and second switching transistors; a first retentive capacity connecting line for connecting the first retentive capacity with the first and second transistors on the semiconductor substrate; and a second retentive capacity connecting line for connecting the second retentive capacity with the third and fourth transistors on the semiconductor substrate.

* * * * *